US007220012B2

(12) United States Patent
Liu

(10) Patent No.: US 7,220,012 B2
(45) Date of Patent: May 22, 2007

(54) ILLUMINATING CLIP FOR PEN

(76) Inventor: Yu-Yin Liu, P.O.Box 166-13, Taipei (TW) 115

( * ) Notice: Subject to any disclaimer, the term of this patent is extended or adjusted under 35 U.S.C. 154(b) by 0 days.

(21) Appl. No.: 11/258,323

(22) Filed: Oct. 26, 2005

(65) Prior Publication Data

US 2007/0041178 A1 Feb. 22, 2007

(30) Foreign Application Priority Data

Aug. 22, 2005 (TW) ..... 94214317 U

(51) Int. Cl.
*B43K 29/10* (2006.01)

(52) U.S. Cl. ..... 362/118; 362/191; 362/396

(58) Field of Classification Search ..... 362/118.191, 362/396, 191, 118; 401/195
See application file for complete search history.

(56) References Cited

U.S. PATENT DOCUMENTS 1,199,392 A * 9/1916 Lenzikow et al. ..... 362/118
5,845,985 A * 12/1998 Xiong et al. ..... 362/118
6,702,499 B1 * 3/2004 Fang ..... 362/118

* cited by examiner

*Primary Examiner*—Stephen F Husar
(74) *Attorney, Agent, or Firm*—Buus, Kim, Kuo & Tran, LLP; John D. Tran

(57) ABSTRACT

The present invention is aimed to provide a clip for pen, in particular, the marks or logo on the clip can emit light and slide on rails. The illuminating clip includes a conducting clamp (6), at least an illuminating device (7), the conducting clamp (6) having a first and second conductors (61),(62) separated from each other; both top ends of the conductors (61),(62) led into pen (10) to contact the anode and cathode of the batteries (31); the illuminating device (7) is disposed on the conducting clamp (6), at least one LED (73) disposed inside the conducting clamp (6), two conducting metal leads (74), (75) extended from the underside of the LED to contact the conductors (61), (62); Thereby, a switch disposed on the pen (10) controls one of the circuits between the conductors and the batteries to light the illuminating device or not.

4 Claims, 5 Drawing Sheets

ILLUMINATING CLIP FOR PEN

FIELD OF THE INVENTION

The present invention relates to ball pen, particularly to a clip for pen, which can be actuated to light by a switch.

GROUND OF THE INVENTION

At present time, there are various pens can emit light on the market, but the lighting ways are different from one another, such as an LED disposed at the top end of a ball pen, can be used for night illumination, or emitting light for fun, while an LED disposed to the bottom end of the ball pen can spot light on the paper for writing; an LED hidden in the middle portion of shaft of ball pen can emit light downward to emphasize the fashion of the shaft, or emitting light outward for advertising. The ways for activating LEDs to light includes a pressure-sensitive switch on the top end of a ball pen, a button-pressed switch on lateral side of a ball pen, rotating the upper or lower shaft of a ball pen, and many kinds of switch for controlling LEDs. Up to now, the clip for pen still has no way to light. In other words, persons skilled in the art never think so—a clip for pen can be designed for illuminating.

Rather, a large number of clip for ball pens have marks fixed to the clips for pen, which is suitable for a trademark or an advertisement, on the surface of the marks, there are icons, until now, there has no such illuminating icons provided by persons skilled in the art to the clip for pen. In other words, marks on the clip for pen are still the conventional trademarks or advertisements.

The illuminating portions of the aforesaid pens are confined to the top end, bottom end, and suitable location on the shaft. Neither the clip for pen nor the marks on the clip have been designed for illuminating. If the clip for pen can be designed for illuminating, it must be conspicuous with novel, specific effect. The lighting clip for pen not only to deserves a promotion effort but also challenges the idea of illuminating pen.

SUMMARY OF THE INVENTION

Accordingly, the present invention is aimed to provide a clip for pen can emit light includes a conducting clamp (6) having a first conductor (61) and a second conductor (62) disposed separately, both top ends of the first, second conductors guided into a ball pen (10) to contact with the anode and cathode of a set of batteries (3), at least an illuminating device (7) mounted on the clamp (6), at least an LED (73) with two metal leads (74), (75) extended out to contact said conductors (61) and (62), thereby a switch disposed on the ball pen (10) can control one of circuits between the conductors and the set of batteries to determine whether the illuminating device (7) is lit up or not.

As mentioned above, the conductors (61) and (62) are disposed separately, an insulator (65) connects and fixes to both bottom ends of the conductors (61) and (62).

As mentioned above, conductors (61) and (62) clamped to two sides of the insulated clip, the upper end of the clip secured to the shaft of pen.

As mentioned above, the illuminating device (7) includes a lamp seat (71) hung from and clamped to the clip for pen, and a PCB (72) disposed on the lamp seat (71); an LED (73) disposed on said PCB, two metal leads extended from the underside of LED passed through the lamp seat (71) to contact the conductors (61),(62).

As mentioned above, two channels (712) formed on both lateral sides of the lamp seat (71) respectively for receiving the conductors (61), (62) to glide therein.

As mentioned above, left and right clamp blocks (76) formed on the lamp seat (71) for clamping two conductors (61), (62).

As mentioned above, a spiral spring (64) is employed to press down the top end of the set of batteries (3), meanwhile the spiral spring (64) is connected to the second conductor (62).

As mentioned above, the top end of the second conductor (62) is separated from the upper shaft of pen by an insulated cover (63).

Comparison Between the Present Invention and the Prior Arts

The merits can be achieved by realization of the present invention, in which: Conductors (61), (62) are separated from each other, when they are disposed on the conducting clamp (6) for pen; the illuminating device (7) disposed on the conducting clamp (6) mostly contacts with the conductors (61), (62) by its metal conducting leads (74), (75). While a responsive switch (4) controls the set of batteries (3), the positive and negative currents are conducted to the two conductors (61), (62) simultaneously, the LEDs (73) of the illuminating device (7) are activated to light; conversely, the responsive switch (4) makes one of the circuits of the set of batteries (63) open, the currents can not be conducted to the first conductor (61), the LED (73) of the illuminating device (7) is dim. Thereby, the clip for pen can emit light from its mark to show up.

When the conducting clamp (6) is in practice by sole rail or dual rails, the illuminating device (7) can be slided and moved without interference of its light effects.

DETAILED DESCRIPTION OF THE PRESENT INVENTION

FIRST EMBODIMENT

Figure 1:
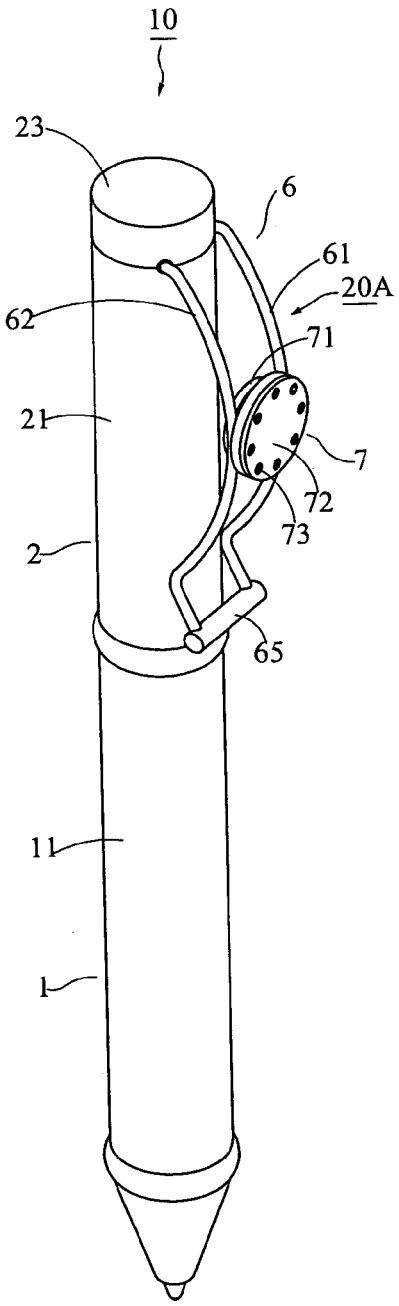
FIG. 1: a perspective view of the clip combined to the pen of the first embodiment of the present invention.
Figure 2:
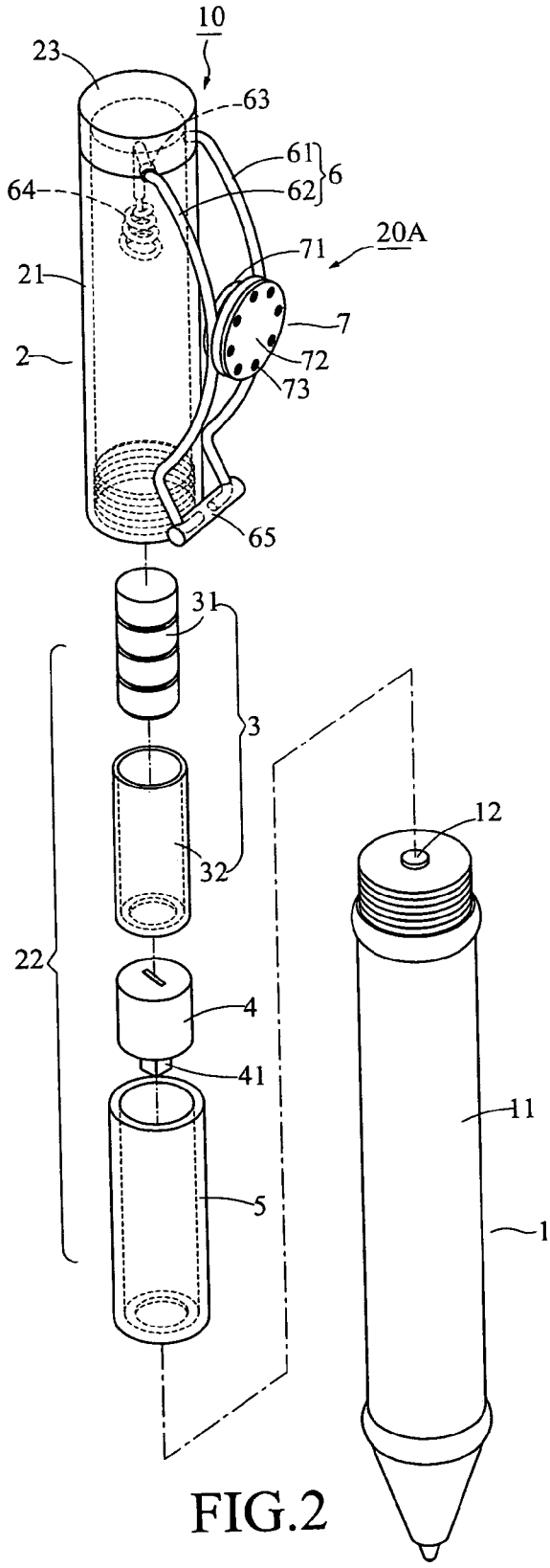
FIG. 2: a perspective view of the clip detached from the pen of the first embodiment of the present invention.

As shown in FIGS. 1 and 2, an assembled and exploded views of the clip (20) and pen (10) of first embodiment of the present invention are illustrated. Clip (20A) for pen is combined to an outer wall of the upper end of the pen (10), which is hung from and clamped to the pocket of the clothing. In the present invention, the pen (10) is a writing instrument with a power control switch. The means for activating the power source includes pressing down the top end, rotation of the shaft, shift toggles on the sidewall, and other means for activating the power source. No matter what the means for activating the power source of pen (10) are, it should be confined in the scope of the present invention.

As shown in FIG. 2, exemplified by activating the power source through twisted of the shaft, the pen (10) includes a writing instrument (1), a battery seat (2) combined to the writing instrument (1); in that, the writing instrument (1) has a lower shaft (11) which can be rotatable, a refill (12) with an up and down mechanism (not shown, prior art) disposed inside the lower shaft (11); the battery seat (2) having a metal wall upper shaft (21), an energy handling mechanism (22) mounted inside the upper shaft (21), the energy handling mechanism (22) consists of a set of batteries (3), a responsive switch (4) disposed below the set of batteries (3), a metal sleeve (5) for combining the set of batteries (3) with the responsive switch (4), said the set of batteries (3) is composed of a number of batteries (31) and an insulated sleeve (32).

Figure 3:
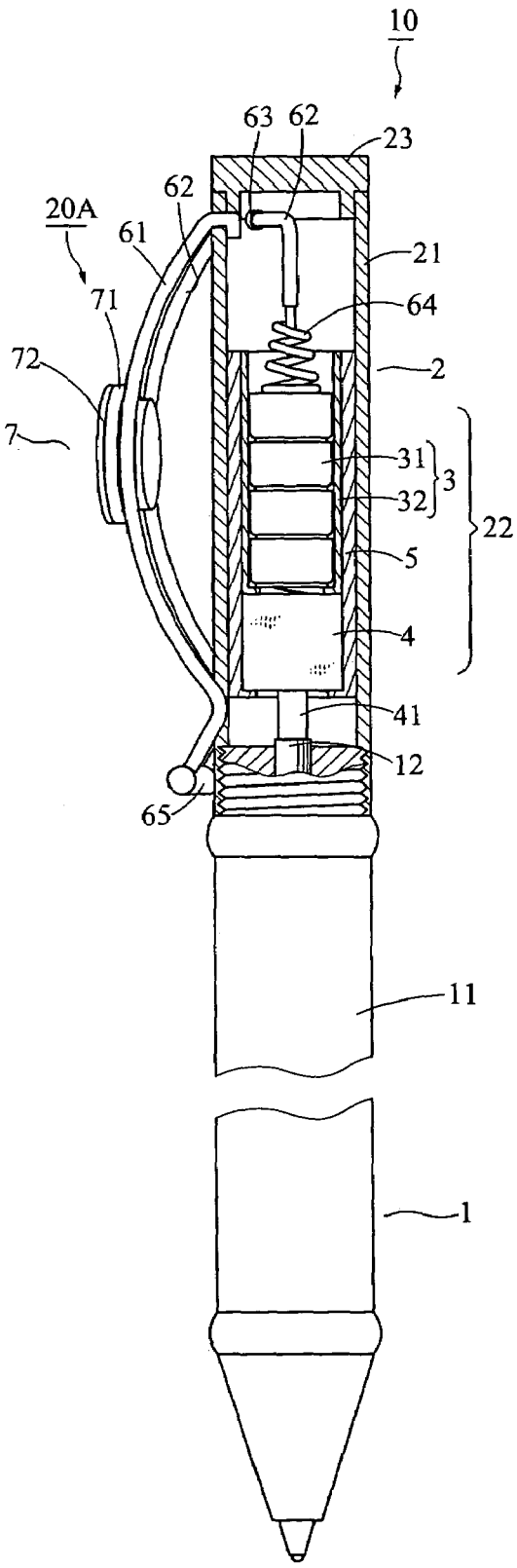
FIG. 3: a cross section view of the clip combined to the pen of the first embodiment of the present invention.

As shown in FIG. 3, a cross section view of the first embodiment of the present invention is illustrated. A responsive switch (4) disposed below the set of batteries (3) is in contact with an anode of the batteries (31). A control key (41) disposed below the responsive switch (4); the control key (41) is corresponding to the refill (12). When the refill (12) is lift, the control key (41) is being pressed to conduct the responsive switch (4), and the positive current of the batteries (31) passes through the responsive switch (4) and a metal sleeve (5) to the upper shaft (21). Conversely, when the refill (12) is descended, the control key (41) is not pressed by the refill (12), the responsive switch is provided as a short circuit protection, the positive current is not conducted to the upper shaft (21). By the way, an up and down mechanism (not shown) disposed inside the lower shaft (1) urges the refill (12) to lift or descend, which generates up and down movements in a well-known spirally pushing forward or pulling rearward way.

As shown in FIGS. 2 and 3, a clip (20A) for pen includes a conducting clamp (6), and at least an illuminating device (7); in which, the conducting clamp (6) having a first and second conductors (61), (62) separated from each other. Two conductors (61), (62) are shaped as longer conducting metal leads, both the top ends of the conductors (61), (62) extended into the upper shaft (21), whereas the bottom ends of the conductors (61), (62) are separated from the upper shaft (21). Thereby, the clip (20A) can be clamped to and hung from a pocket of the clothing. While the illuminating device (7) is disposed on the conducting clamp (6), at least an LED (73) disposed inside of the illuminating device (7), two conducting metal leads (74) extended to the outer side of the illuminating device (7) (refer to FIGS. 6 and 7) to contact the two conductors (61), (62) of the conducting clamp (6).

Top end of the first conductor (61) is in contact with the metal wall of the upper shaft (21), (refer to FIG. 3) or extended to contact the conducting metal sleeve (5); the top end of the second conductor (62) is extended into the upper shaft (21) to contact the cathode of the batteries (31). The second conductor (62) can be insulated from contacting with the metal wall of the upper shaft by an insulation sleeve (63) disposed to an outer edge of the second conductor (62), or the second conductor (62) leads in an insulation cap (23) through a lateral wall thereof. To hinder the energy handling mechanism (22) from up and down vibration, a metal spring (64) can be added to resist against on the batteries (31), meanwhile the second conductor (62) is also connected to the spring (64). Thereby, the energy handling mechanism (22) can keep stable in balance without up and down vibration by the second conductor (62) extended in between or the insulation cap (23) covered on top thereof.

The positive current of the batteries (31) flows through the responsive switch (4) and the metal upper shaft (21) to the first conductor (61), whereas the negative current of the batteries (31) flows through the spring (64) to the second conductor (62). When the first and second conductors (61), (62) are energized at the same time, the illuminating device (7) can be lit up. Whereby, either positive or negative circuit controlled by a switch can determine whether the illuminating device (7) of the conducting clamp (6) light or not. In this embodiment, the circuit from anode of the batteries (31) to the first conductor (61) is controlled by a responsive switch (4); rather, in which the refill (12) is lifted or descended by rotating the upper or lower shaft (11), (21) to urge the responsive switch (4) open or close the circuits. Otherwise, a pressure-sensitive switch (4) can be disposed on the top end of the batteries (31), which is dependent on a press down mechanism (not shown, prior art) disposed on the top end of the pen (10) to control the circuits.

Figure 5:
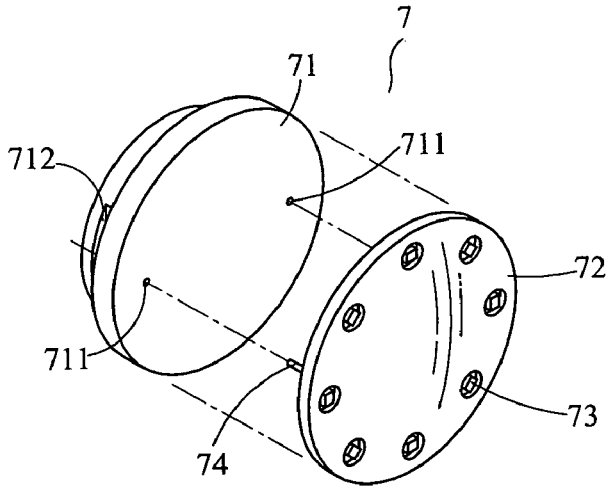
FIG. 5: an exploded view of the illuminating device of the first embodiment of the present invention.
Figure 6:
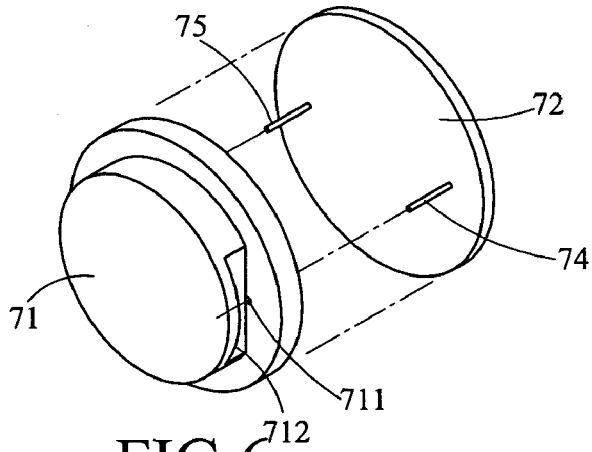
FIG. 6: an exploded view of the illuminating device of the first embodiment of the present invention perceived from different angle.
Figure 7:
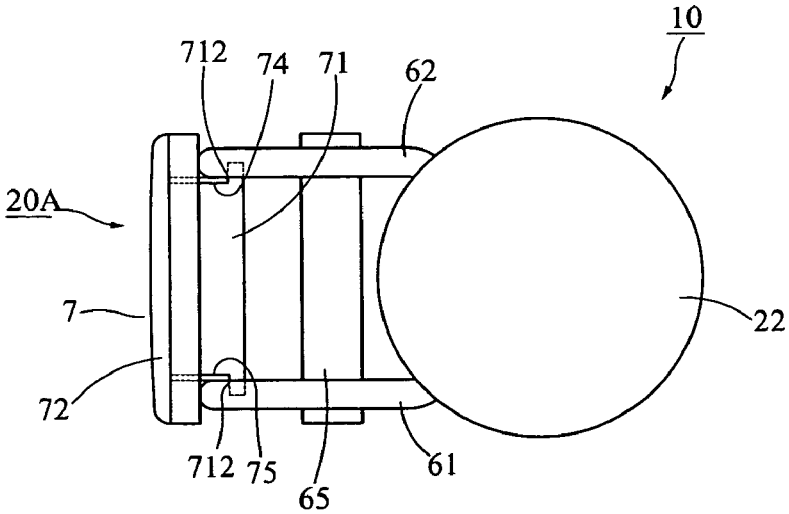
FIG. 7: a top plan view of the clip combined to the pen of the first embodiment of the present invention.

As shown in FIGS. 5 and 6, exploded views of the illuminating device (7) of the present invention are illustrated in different angles. An illuminating device (7) includes a lamp seat (71) clamped to and hung from a conducting clamp (6), and a PCB disposed on the lamp seat (71). The PCB (72) has LEDs (73) coating with epoxy pervious to light or a resin plate printed with trademark or logo on the surface of the PCB. Two conducting metal leads (74),(75) extended from the underside of the PCB pass through a through hole (711) to contact the two conductors (61), (62), as depicted in FIG. 7, a top plan view is illustrated as shown.

As described above, two conductors (61), (62) are shaped as two parallel rails for sliding the illustrating device (7) on the rails, two channels (712) are required to form on the lateral sides of the lamp seat (71) for receiving the two conductors (61), (62) to embed in the channels (712) of the lamp seat (71). Besides, both the conductors (61), (62) can be hung from and clamped to, or connected in series, for sliding the lamp seat (71). No matter what the means for sliding the two conductors (61), (62) toward and away the lamp seat (71), it should be confined in the scope of the present invention. Further, for preventing the illuminating device (7) detached from the two conductors (61), (62), an insulator (65) can be connected to, for example, the lower ends of the two conductors (61),(62). The insulator (65) can be made from dual hole rubber tube, insulated bead, or an insulated rubber tube, no matter what the insulated means are, it should be confined in the scope of the present invention.

Figure 4:
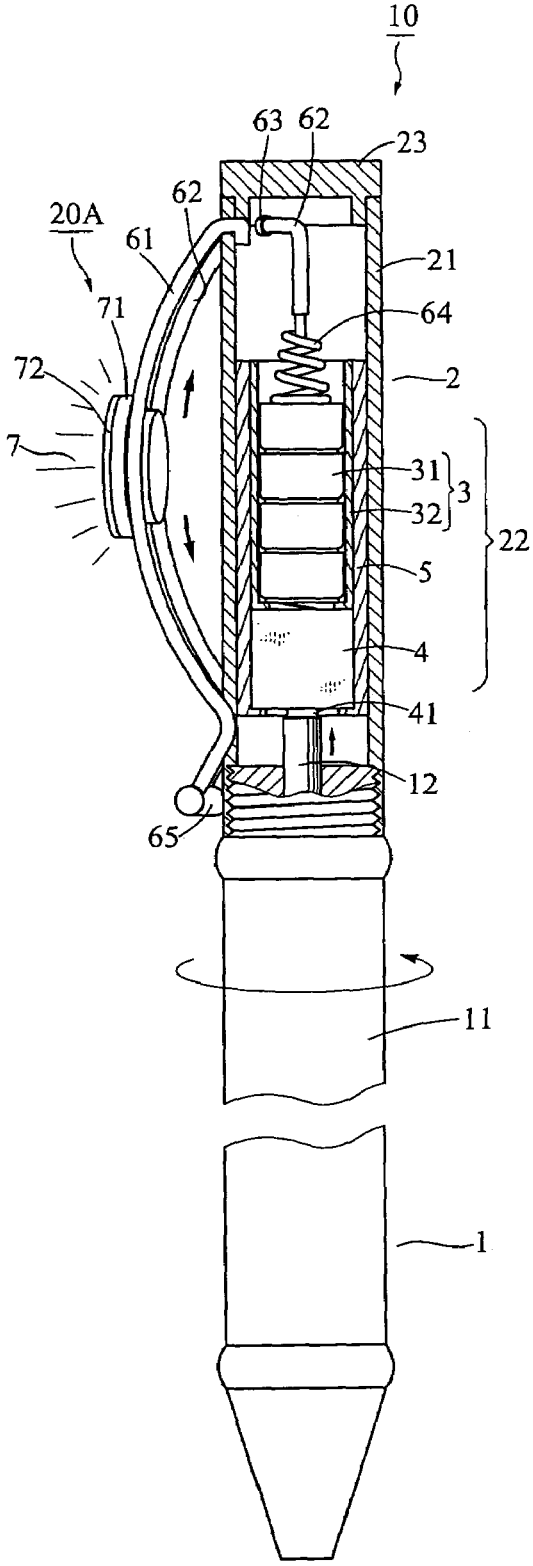
FIG. 4: a schematic view of the first embodiment of the present invention.

As shown in FIG. 4, a schematic view of the present invention is illustrated. When the lower shaft (11) is rotated in clockwise direction, the refill (12) is uplifted to conduct the responsive switch (4). The positive current of the batteries (31) flows through the responsive switch (4), conducting metal sleeve (6), and the metal upper shaft (21) to energize the first conductor (61), while the second conductor (62) is energized normally by contacting with the cathode of the batteries (31). Due to the two conducting metal leads (74),(75) of the illuminating device (7) (as shown in FIGS. 6 and 7) are in contact with the conductors (61), (62) through life so that the PCB (72) are energized with the positive and negative currents to light the LEDs (73). Further, the PCB (72) has integrated circuits (IC, not shown), a number of LEDs (73) can be lit up according to the timing schedule, intermittence process, glittering, or running rapidly or slowly. Conversely, when the lower shaft (11) is rotated in counterclockwise direction, the refill (12) is descend and the responsive switch resulting in a short circuit, the positive current of the batteries (31) can not conduct to the first conductor (61). The illuminating device (7) can not be energized by both of the positive and the negative currents, the LEDs are dim.

Further, the illuminating device (7) can slide onto the dual rails like conducting clamp (6), in other words, only pushing the illuminating device (7) to move up and down by fingers, when moving, the illuminating device (7) still can be actuated to light.

Furthermore, LEDs (73) can be practiced by either SMD LED, LED, mini bulb, even the optical fiber etc. When the illuminating device (7) is lit up, the trademark or logo on its surface can be emphasized to achieve a preferable advertising effect. Rather, a number of LEDs (73) can be illuminated according to a timing schedule or alternately running light in cycles.

A number of LEDs (73) or ICs (not shown) are incorporated into the PCB (72) and then combined and secured to the lamp seat (71), which is easy for manufacturing, processing and combination. Though, this embodiment is suitable for a PCB (72) with complex circuits. But it also simplify the steps of the LED (73) combined to the PCB (72), or LED (73) combined to the lamp seat (73), further the lamp seat (71), or PCB (72) fixes or not to the conducting clamp (6) by sliding on rails toward and away conducting clamp (6). The illuminating device (7) depicted in the drawings is not used to restrict to the scope of the present invention. Once the two conducting metal leads (74), (75) are in contact with the two conductors (61), (62) to light the LEDs (73) or not, it should be confined in the scope of the present invention.

SECOND EMBODIMENT

Figure 8:
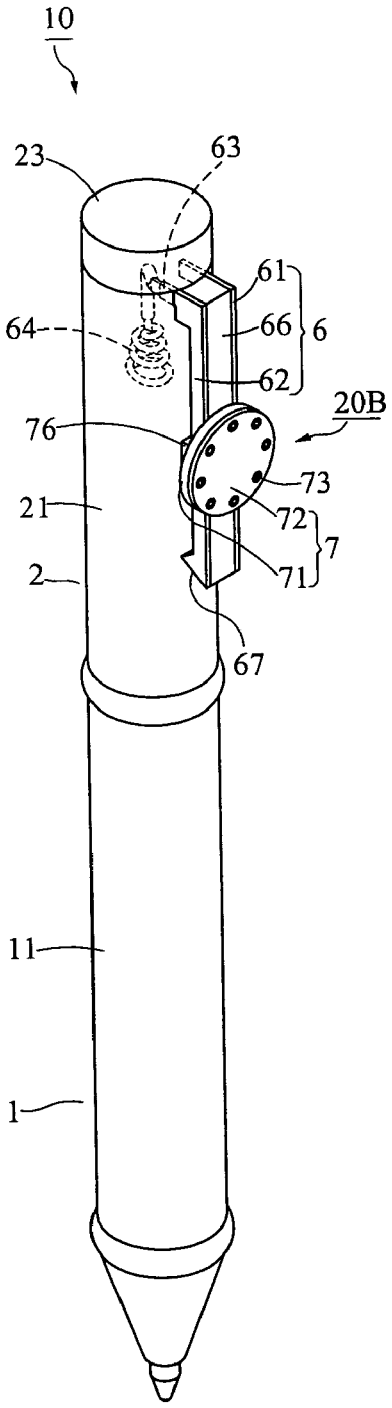
FIG. 8: a perspective view of the clip combined to the pen of the second embodiment of the present invention.
Figure 9:
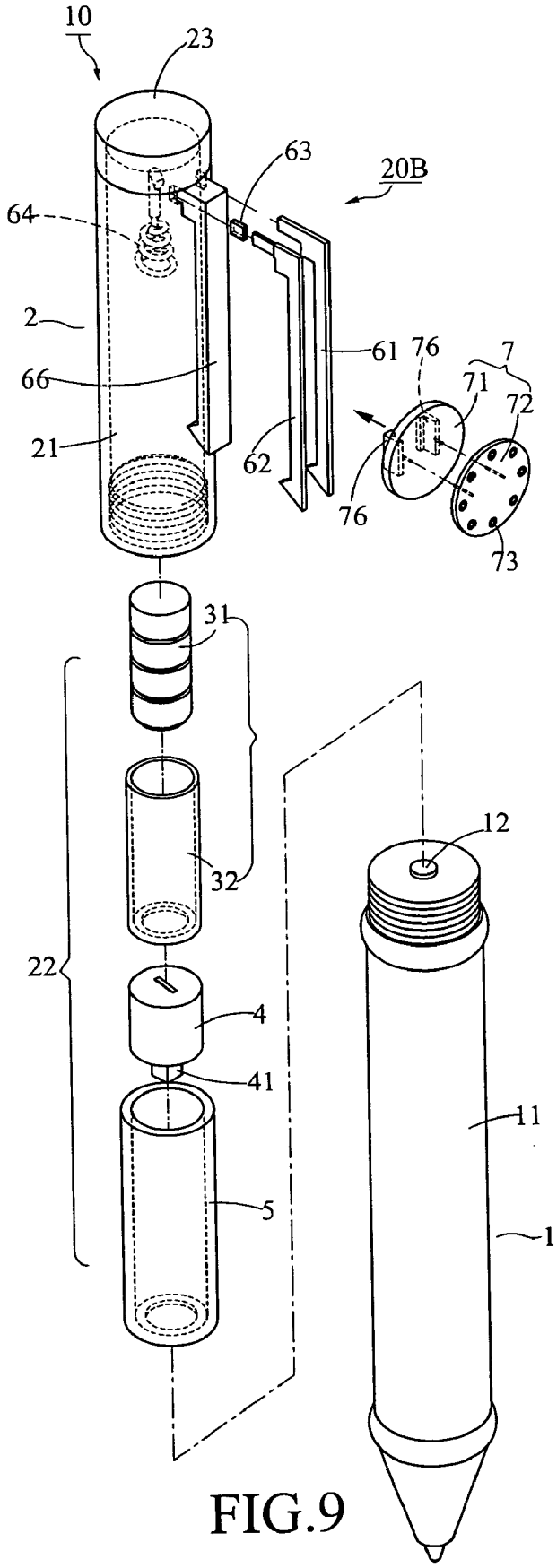
FIG. 9: a perspective view of the clip detached from the pen of the second embodiment of the present invention.

As shown in FIGS. 8 and 9, a perspective and an exploded views of an illuminating clip (20B) for pen (10) of the second embodiment of the present invention are illustrated. The pen (10) is identical to the pen in the first embodiment. The clip (20B) for pen is different from the clip (20A) for pen in the first embodiment. Such as the conducting clamp (6) is composed of two conductors (61), (62) separated from each other; two conductors (61), (62) are also pressed from each side of an insulating clip (66) respectively, the upper end of the insulating clip (66) is secured to the upper shaft (21) so that the conducting clamp (6) is shaped as a sole rail for sliding the illuminating device (7), which is different from the conducting clamp (6) in the first embodiment sliding on dual rails. Because the bottom end of the conducting clamp (6) has a stopper hook (67) to prevent the illuminating device (7) detached from the conducting clamp (6).

Further, the illuminating device (7) is designed to adapt to a sole rail conducting clamp (6), two L-type clamp blocks (76) are disposed to the underside of the illuminating device (7) for clamping to the two lateral sides of the conducting clamp (6). Therefore, the illuminating device (7) slides smoothly.

The illuminating device (7) of the second embodiment except the clamp blocks (76) different from the illuminating device (7) of the first embodiment, other components are identical to each other. Meanwhile the two conducting metal leads (73) are in contact with the two conductors (61), (62) of the conducting clamp (6) normally.

Moreover, two conductors (61), (62) formed as longer metal leads are illustrated as shown in FIGS. 8 and 9. In which, the top end of the first conductor (61) is combined and secured to the metal upper shaft (21), whereas the second conductor (62) leads in the upper shaft (21) to connect to the spring (64), the outer edge of the second conductor (62) covered with an insulation sleeve (63) to avoid from contacting with the metal upper shaft (21).

Figure 10:
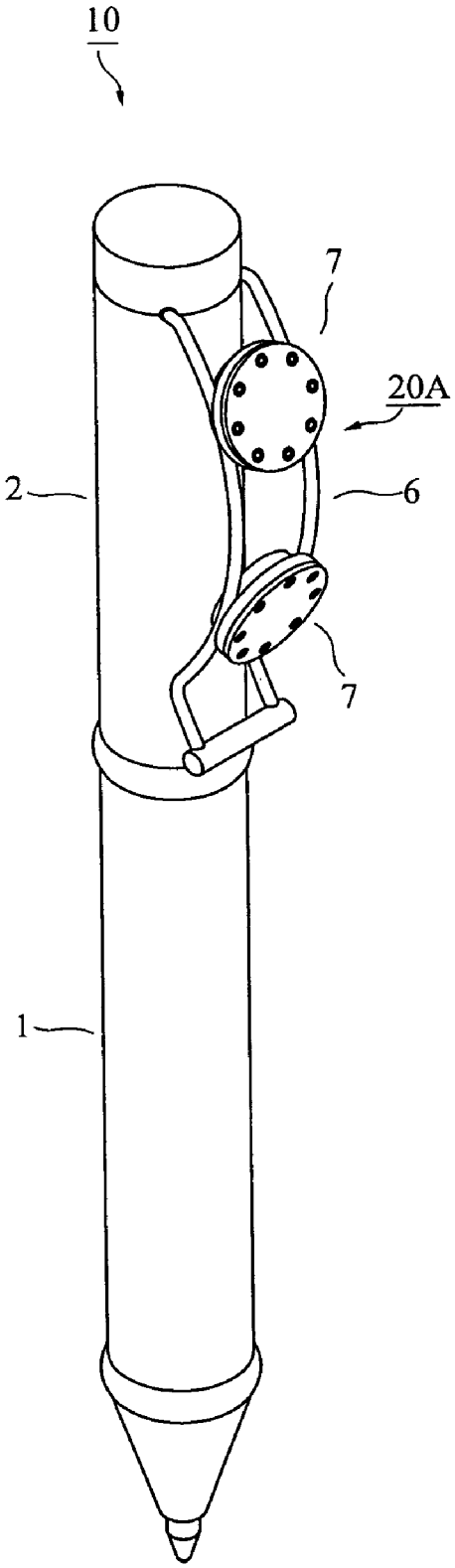
FIG. 10: another embodiment of the first embodiment of the present invention.
Figure 11:
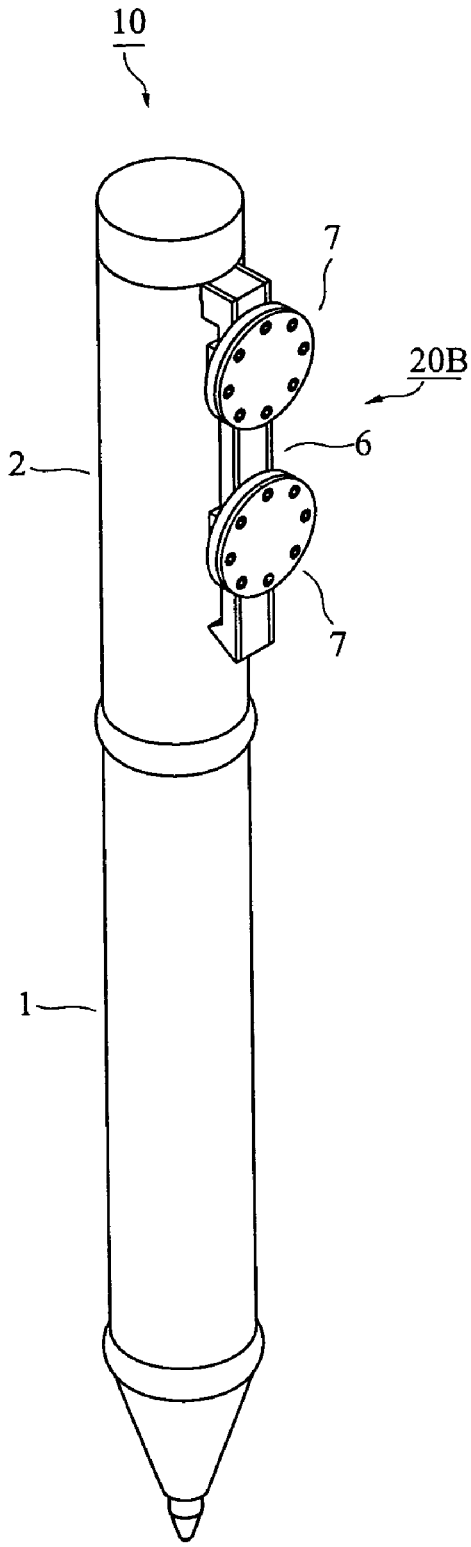
FIG. 11: another embodiment of the second embodiment of the present invention.

As shown in FIGS. 10 and 11, another embodiments of the first and second embodiments of the present invention are illustrated. In which, at least one illuminating device (7) can be disposed to the conducting clamp (6) of the illuminating clip (20A) and (20B). While the illuminating device (7) can slide and illuminate on the conducting clamp (6).

As described above, the present invention is an illuminating clip of the ball pen having marks or logos can be activated to slide and emit light. The preferable embodiments of the present invention are illustrated by the appended drawings. A person skilled in the arts can modify and vary in many ways. Such variations are not to be regarded as a departure from the spirit and scope of the present invention, and all such modifications are intended to be included within the scope of the following claims.

What is claimed is:

1. A clip for pen can emit light comprising:

a conducting-clamp (6) having a first conductor (61) and a second conductor (62) disposed separately, both top ends of the first, second conductors led into a ball pen (10) to contact with the anode and cathode of a set of batteries (3) the top end of the second conductor (62) is separated from the upper shaft of pen by an insulated cover (63), and at least an illuminating device (7) disposed on the clamp (6), at least an LED (73) with two metal leads (74), (75) extended out to contact said conductors (61) and (62), a switch disposed on the ball pen (10) can control one of circuits between the conductors and the set of batteries.

2. A clip for pen can emit light according to the claim 1, wherein the conductors (61) and (62) are disposed separately, an insulator (65) connects and fixes to both bottom ends of the conductors (61) and (62).

3. A clip for pen can emit light according to the claim 1, wherein conductors (61) and (62) clamped to two sides of an insulating clip, the upper ends of the clip secured to the shaft of pen.

4. A clip for pen can emit light according to the claim 1, wherein the illuminating device (7) includes a lamp seat (71) hung from and clamped to the clip for pen, and a PCB (72) disposed on the lamp seat (71); the LEDs (73) disposed on said PCB (72), two metal leads extended from the underside of LED passed through the lamp seat (71) to contact the positive and negative conductors (61),(62).

* * * * *